US005749182A

United States Patent [19]

Vavrinak

[11] Patent Number: 5,749,182

[45] Date of Patent: May 12, 1998

[54] FOUNDATION PROTECTION PANEL SYSTEM

[76] Inventor: Ronald Vavrinak, P.O. Box 15, Farmdale, Ohio 44417

[21] Appl. No.: 804,719

[22] Filed: Feb. 21, 1997

[51] Int. Cl.[6] ..... E02D 19/00

[52] U.S. Cl. ..... 52/169.14; 52/58

[58] Field of Search ..... 52/169.14, 515, 52/516, 58, 62, 200; 428/119, 120, 121

[56] References Cited

U.S. PATENT DOCUMENTS

| | | | |
|---|---|---|---|
| 4,700,512 | 10/1987 | Laska | 52/58 |
| 4,799,986 | 1/1989 | Janni | 52/58 |
| 4,907,386 | 3/1990 | Ekroth . | |
| 5,044,821 | 9/1991 | Johnsen . | |
| 5,218,793 | 6/1993 | Ball . | |
| 5,535,556 | 7/1996 | Hughes, Jr. | 52/169.14 X |
| 5,630,297 | 5/1997 | Rutherford | 52/58 |

*Primary Examiner*—Creighton Smith
*Attorney, Agent, or Firm*—Harpman & Harpman

[57] ABSTRACT

A system for protecting the exposed upper surface of a building foundation during construction and therein after. The system comprising multiple pre-formed panels and shapes made of relatively thin stiff synthetic resin material. The system provided overlapping main panels that extend above the foundation and are secured to the building by common fasteners. The main panels overlie foam insulation foundation boards attached to the foundation protecting them from damage and defining a pre-finished durable transitional surface from the structure over the upper portion of the foundation to the grade.

10 Claims, 3 Drawing Sheets

FOUNDATION PROTECTION PANEL SYSTEM

BACKGROUND OF THE INVENTION

1. Technical Field

This system relates to protection and drainage systems for building foundations formed of cement block or poured walls that are typically water-proofed and insulated on their exterior surface below and above the final grade.

2. Description of Prior Art

Prior art devices and systems used on foundation walls have been generally directed to sheets of sealing material and water directional devices used to overlie the foundation walls to protect same from transfiltration of non-desirable elements, see for example U.S. Pat. Nos. 4,907,386, 5,044,821, 5,218,793.

In U.S. Pat. No. 4,907,386 a shield for building foundations is disclosed formed of a multiple layer sheeting having alternating layers of polymer sheet, metal foil and polymer sheet. This sheeting is placed about and around a subterranean foundation to prevent infiltration of radon gas into the structure.

U.S. Pat. No. 5,044,821 is directed to a system for protecting foundation walls and the like formed of sheets of material having a plurality of molded protrusions within them to be mounted on the wall and the footer of the foundation. The system protects the walls while providing improved drainage by the spacing properties of the protrusions against the foundation surface.

U.S. Pat. No. 5,218,793 discloses a combination sill sealer and flashing that is formed of a sheet of flexible material that is vapor permeable and liquid impermeable.

SUMMARY OF THE INVENTION

A multiple panel system of stiff synthetic resin formed material that is secured to the transition area between the building and the foundation to extend down and over the exposed surface of the foundation above the finished grade. The panels protect single or multiple sheets of rigid foam insulation attached to the exterior surface of the foundation. The system includes corner strips and cap forms with overlapping preformed sidewall panels that enclose the exposed foam surface of the foundation above grade.

DESCRIPTION OF THE PREFERRED EMBODIMENT

Figure 1:
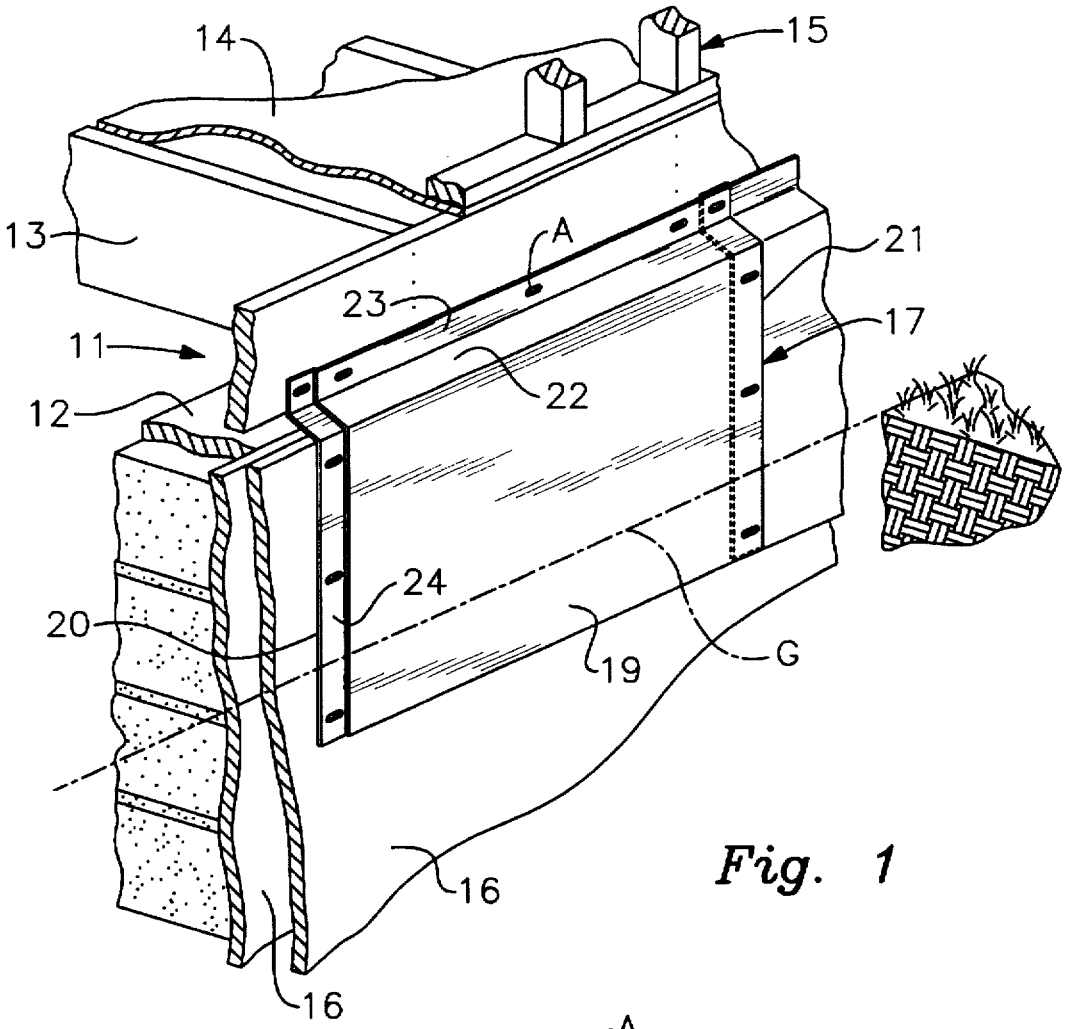
FIG. 1 is a partial perspective view of a typical building foundation and floor structure with the protection panel system of the invention installed thereon.

Referring to FIG. 1 of the drawings, a foundation wall 10 and floor assembly 11 can be seen wherein the foundation wall 10 has a sill plate 12 with floor joyces 13, sub-floor 14 and wall framing 15 as will be evident in standard construction practices. A plurality of rigid foam insulation boards 16 are secured over the foundation wall 10 in two overlapping layers.

Figure 4:
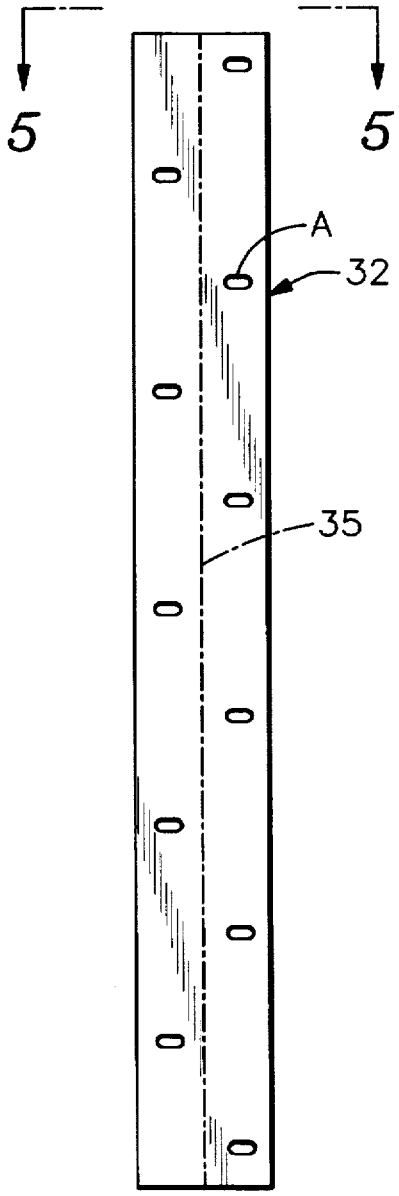
FIG. 4 is a side elevational view of a corner cover sheet of the invention.

Referring now to FIGS. 1, 4, 7 and 8 of the drawings, a main protection panel 17 of the invention and an alternate panel 18 can be seen wherein the protection panel 17 is made of a relatively thin stiff synthetic resin compound molded into a generally rectangular body member 19 with oppositely disposed end portions 20 and 21. An offset elongated upper portion 22 has an upstanding engagement mounting flange 23 extending therefrom with a plurality of longitudinally spaced apertures A therein. The offset portion 22 determines the relative horizontal (offset) distance between the engagement mounting flange 23 and the flat portion of the body member 19. The main panel 17 has an offset elongated tongue portion 24 formed inwardly along the end portion 22. The offset tongue portion 24 provides for end to end adjacent panel overlapping as illustrated in FIGS. 1 and 4 of the drawings. A plurality of vertically spaced elongated apertures (A) are formed in the offset tongue portion 24 as well as in the oppositely disposed end portion 21 to accommodate fasteners (not shown) when aligned to one another in overlapping relationship as will be well understood by those skilled in the art.

The main panel 17 of the invention is secured to the end floor joyce 13A by the engagement mounting flange 23 with the offset elongated portion 22 extending over the upper ends of the foam insulation board 16 with the remaining flat portion of the body member 19 of the invention extending vertically overlying the exposed upper portion of the foam board 16 that remain above grade (G), best seen in FIG. 1 of the drawings.

Figure 7:
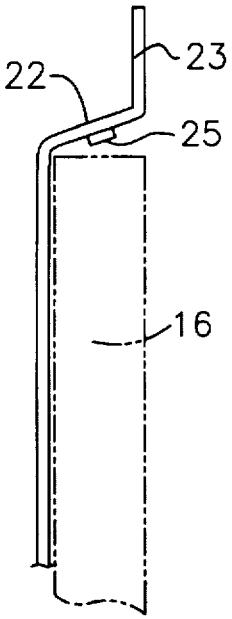
FIG. 7 is a partial end elevational view of an alternate main panel configuration of the invention over a single layer of foam insulation board.
Figure 8:
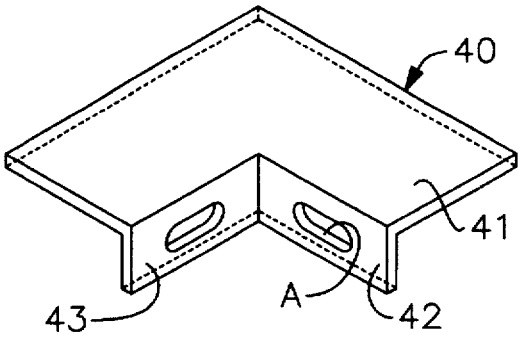
FIG. 8 is a perspective view of an inside corner end cap of the invention.

Referring now to FIGS. 7 and 8 of the drawings, the main panel 17 of the invention and alternate panel 18 are seen overlying different layered combination of the rigid foam board's insulation board 16. In FIG. 7, for example, the main panel 17 accommodates two layers of foam board 16 with a horizontal offset determination of approximately 2¼ inches between the upstanding flange 23 and flat portion of the body member 19.

Conversely, in FIG. 8 of the drawings the alternate panel 18 accommodates a single layer of rigid foam board 16 with approximately 1¼ inch of horizontal offset, as noted above.

Figure 11:
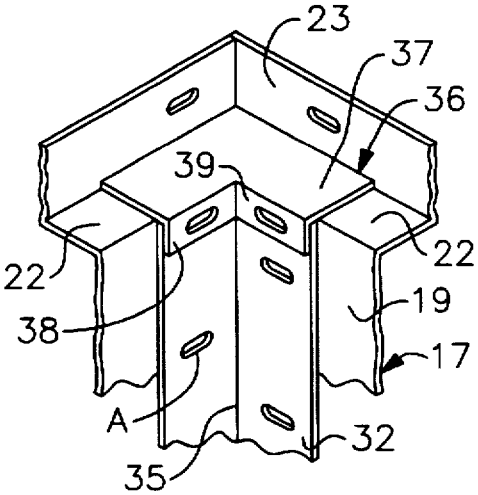
FIG. 11 is a perspective view with portions broken away of an inside foundation corner with the protection system of the invention thereon.

Both the main panel 17 and alternate panel 18 have a series of attachment buttons 25 in longitudinally spaced relation to one another along the underside of the respective offset elongated upper portions 22 for selective registration with an apertured nailing strap 26 as best seen in FIGS. 7 and 11 of the drawings.

The nailing strap 26 is to be used in new construction wherein the strap 26 is frictionally engaged over the attachment buttons 25 and then secured by fasteners (not shown) to the flooring assembly 11 as will be well understood by those skilled in the art.

Figure 5:
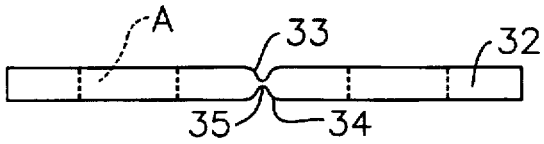
FIG. 5 is an enlarged top plan view on lines 5—5 of FIG. 4.
Figure 6:
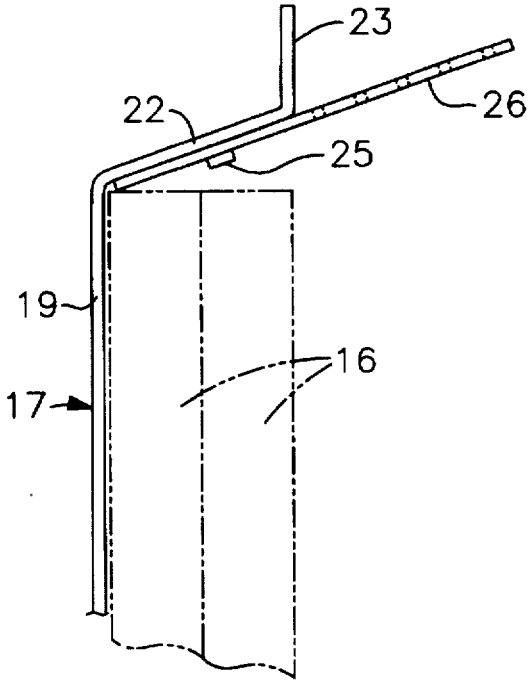
FIG. 6 is a partial end elevational view of the main panel of the invention overlying foam insulation boards shown in broken lines.

Referring now to FIGS. 5, 6, 9–12 of the drawings, an inside and outside corner assemblies 30 and 31 can be seen wherein a transition strip 32 of the same synthetic resin material used in the main panels, best seen in FIGS. 5 and 6 of the drawings has a generally flat elongated rectangular sheet configuration with oppositely disposed elongated grooves 33 and 34 therein defining a living hinge 35 therebetween. The transitional strips 32 are folded lengthwise along the hinge 35 shown in a fold line in FIG. 4 of the drawings and positioned over the abutting ends of the respective pairs of like main panels 17 or 18 at the foundation corner, best seen in FIGS. 10 and 11 of the drawings.

It will be evident that to achieve a 90 degree corner, a section of the elongated portion 22 is cut at a 45 degree angle with an adjacent portion of the upstanding mounting flange 23 being cut away also. An end outside corner cap 36, for example, best seen in FIGS. 10 and 11 of the drawings, has a top portion 37 and adjacent depending sidewalls 38 and 39 extending downwardly therefrom is secured over the junction of the abutting panels 17 and the transition strip 32.

Figure 9:
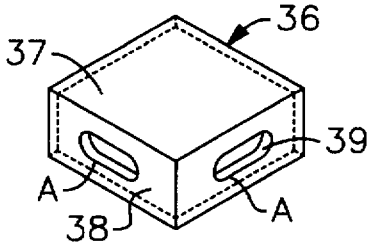
FIG. 9 is a perspective view of an outside corner cap of the invention.
Figure 10:
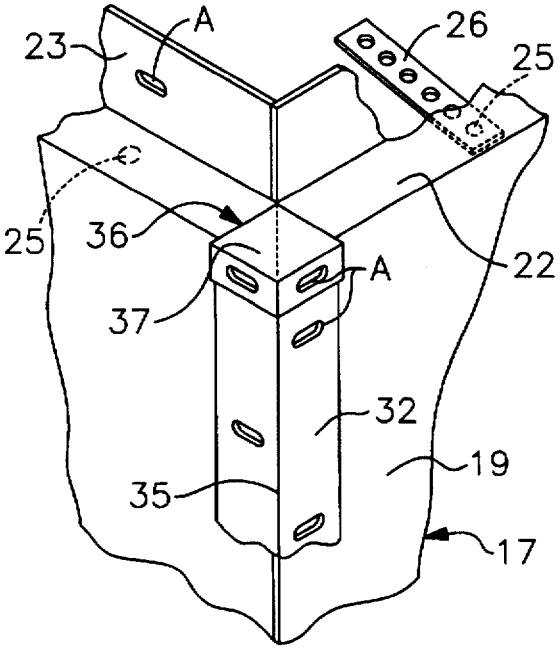
FIG. 10 is a perspective view with portions broken away of an outside foundation with the invention in place.

Correspondingly, an inside corner cap 40, best seen in FIGS. 9 and 12 of the drawings, has a generally L-shaped top portion 41 with adjacent sidewalls 42 and 43 extending downwardly therefrom that overlie the top exposed edge of the transition strip 32 when folded in reverse along the hinge line 35 and applied to the inside abutting corner of adjacent panels 17 or 18 as will be well understood by those skilled in the art.

Both of the respective corner cap wall pairs 38 and 39 and 42 and 43 have elongated apertures (A) therein for selective fastener access to secure same, as noted above.

Figure 2:
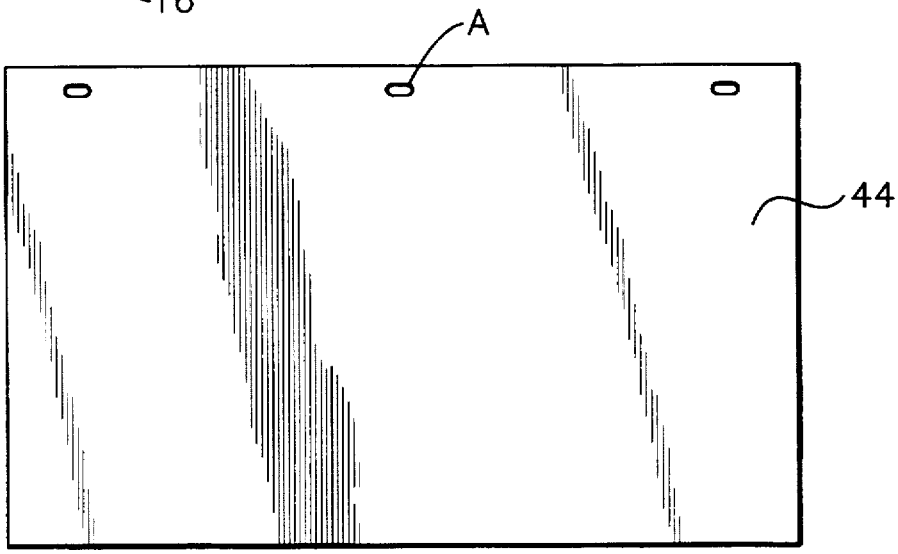
FIG. 2 is a side elevational view of a flat rectangular sidewall transition panel.
Figure 3:
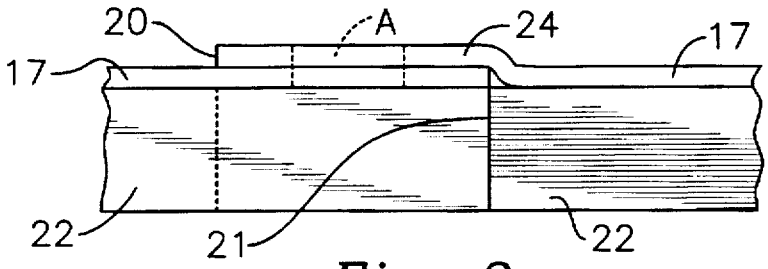
FIG. 3 is an enlarged partial top plan view of the end panel overlap portion of adjacent panels.

Referring now to FIG. 2 of the drawings, an application protection panel 44 can be seen having an overall flat rectangular configuration which is used in conjunction with the main protection panels 17 and 18 and transition strip 32, end corner caps 36 and 40 of the system wherein certain building surface transition (not shown) are required wherein the foam insulation board 16 is not used and the protection panels 42 are applied directly to foundation walls not requiring insulation to maintain the overall surface continuity of the system.

All of the synthetic resin foam elements of the foundation protection system of the invention as hereinbefore described have an outer textured surface molded therein and are of a uniform color as again will be well understood by those skilled in the art.

It will thus be seen that a new and novel foundation protection panel system has been illustrated and disclosed and it will be obvious to those skilled in the art that various modifications and changes may be made therein without departing from the spirit of the invention.

Therefore I claim:

1. A foundation wall protection system on the foundation walls above grade of a building comprising; a first main protection panel made of a thin stiff material, said first main protection panel is of a generally rectangular configuration having oppositely disposed ends, an elongated offset upper portion, an upstanding engagement mounting flange extending from said offset portion, an offset tongue extending from one of said panel ends, means for securing said main protection panel to said building, a corner transition strip engaging with over adjacent panel ends of said main protection panels, means for securing said corner transition strip to said adjacent panel ends and said foundation walls, and secondary means for selectively securing said first main protection panel to said building structure.

2. The foundation wall protection system of claim 1 wherein said foundation walls have at least one overlying layer of insulation board secured thereto.

3. The foundation wall protection system of claim 1 wherein the elongated offset upper portion of said first main protection panel is of a known transverse dimension greater than that of said upstanding engagement mounting flange.

4. The foundation wall protection system set forth in claim 1 wherein said means for securing said first main protection panel to said building structure comprises; a plurality of fasteners registering with a plurality of longitudinally spaced apertures within said panel.

5. The foundation wall protection panel system set forth in claim 1 wherein said means for securing said transition strip to said adjacent panel ends and said foundation walls comprises; corner end caps registering respective portions of said adjacent panel ends and fasteners extending therethrough.

6. The foundation wall protection panel system set forth in claim 1 wherein said corner transition strip has an area of reduced thickness defining an elongated integral hinge therein.

7. The foundation wall protection system set forth in claim 1 wherein said thin stiff material of said first protection panel is formed of synthetic resin material having a textured surface.

8. The foundation wall protection system set forth in claim 5 wherein said corner end caps have a top portion having a pair of adjacent sidewalls extending therefrom.

9. The foundation wall protection system set forth in claim 1 wherein said secondary means for selectively securing said first main protection panel to said building comprises; an apertured nailing strips extending from said elongated offset upper portion and means for attaching said nailing strips to said protection panel.

10. The foundation wall protection system set forth in claim 9 wherein said means for attaching said nailing strips to said protection panel comprises; contoured buttons extending from said elongated offset upper portion in spaced longitudinal relation to one another, said contoured buttons engaging with an apertured portion of said nailing strip.

* * * * *